United States Patent [19]

Corain et al.

[11] Patent Number: 4,870,996

[45] Date of Patent: Oct. 3, 1989

[54] IMPROVEMENTS IN THE GRIPPER TRANSPORTATION SYSTEM OF A SHUTTLELESS LOOM

[75] Inventors: Luciano Corain; Gianni Maitan, both of Vicenza, Italy

[73] Assignee: Nuovopignone-Industrie Meccaniche e Fonderia S.p.A., Florence, Italy

[21] Appl. No.: 225,865

[22] Filed: Jul. 20, 1988

[30] Foreign Application Priority Data

Sep. 18, 1987 [IT] Italy ..... 21956 A/87

[51] Int. Cl.[4] ..... D03G 1/00

[52] U.S. Cl. ..... 139/1 R; 139/45; 139/449

[58] Field of Search ..... 139/1 R, 45, 449; 184/5, 14, 24

[56] References Cited

U.S. PATENT DOCUMENTS

| | | | |
|---|---|---|---|
| 807,406 | 12/1905 | Tunstall | 139/45 |
| 2,167,640 | 8/1939 | Cope | 184/5 |
| 4,188,980 | 2/1980 | Muller | 139/45 |
| 4,520,848 | 6/1985 | Lucian et al. | 139/45 |
| 4,584,893 | 4/1986 | Harding et al. | 184/5 |

*Primary Examiner*—Henry S. Jaudon

*Attorney, Agent, or Firm*—Morgan & Finnegan

[57] ABSTRACT

A gripper transportation system for a shuttleless loom, in which in the guide for the flexible tape, in a position in close proximity to the control sprocket, there is provided a transverse slot through which a solid stick of porous synthetic material impregnated with lubricating grease and/or oil passes and is urged against said tape by a spring of adjustable tension.

3 Claims, 3 Drawing Sheets

Fig.2
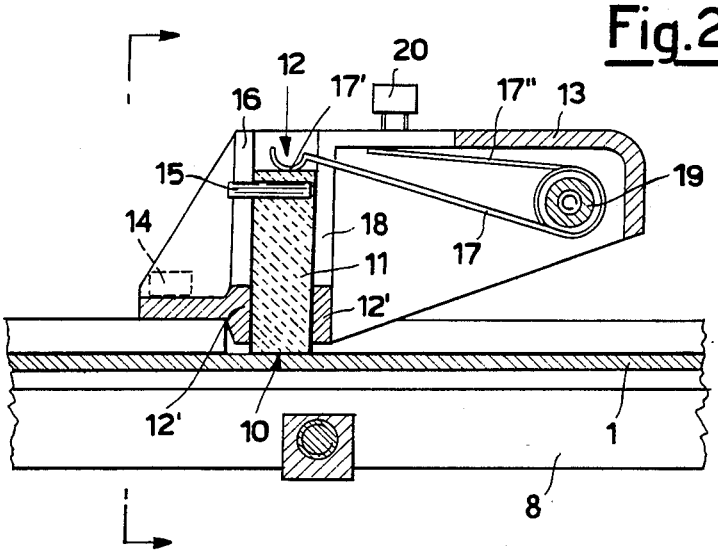
Fig.3
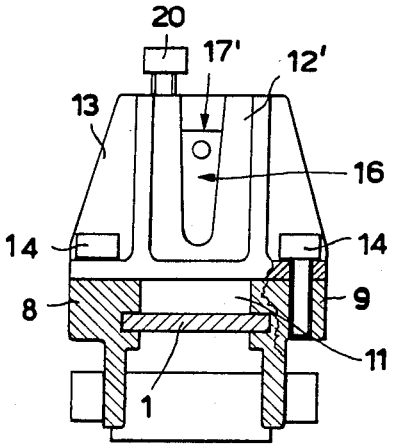
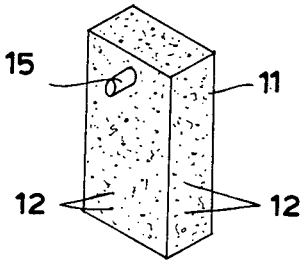
Fig.4

IMPROVEMENTS IN THE GRIPPER TRANSPORTATION SYSTEM OF A SHUTTLELESS LOOM

The invention relates to improvements in the gripper transportation system of a shuttleless loom by which said system is made particularly suitable for modern high-speed looms. In shuttleless looms the weft yarn originating from bobbins located external to the shed formed by the warp yarn is inserted by two grippers which are transported alternately into said shed from opposite sides of the looms until they cross at the shed centre where they exchange the weft yarn and are then withdrawn. This reciprocating movement of each gripper is usually obtained by flexible tape which at one end supports said gripper and is driven with reciprocating rectilinear motion in suitable guides by a control sprocket, the teeth of which are inserted in perforations provided longitudinally in the tape, which embraces the sprocket. This continuous sliding contact between the control sprocket teeth and the tape perforations and between the tape and its guide therefore means that effective lubrication is required, especially in modern high-speed looms, in order to prevent overheating due to the high speed and consequently obtain longer tape life. Various types of lubrication are already known in the state of the art.

The best type of lubrication would be by oil fed by metering equipment, but this type of lubrication system would involve great difficulties in limiting the fed oil quantity to that strictly necessary, without any excess which could deteriorate the quality of the finished fabric. These difficulties increase with increasing speed of operation with the result that in modern high-speed looms oil or grease lubrication must not be used as it is impossible to protect the fabric against soiling with lubricant entrained and sprayed by virtue of the high speed. To obviate this drawback, dry lubrication has been used in which a solid lubricant such as teflon type in the form of a stick is pressed against the tape at points at which the tape is unsupported.

Although this lubrication cannot cause lubricant stains on the fabric, it is not perfect because of its intrinsic characteristics and, in particular, because at high operating speed the solid lubricant does not have time to expand and thus instantly reach all the points to be lubricated.

Again, at high speed the tape is subjected to particularly high combined bending and compressive stresses in proximity to the control sprocket which tend to deflect it vertically, and it must therefore be continuously guided over the entire part of its travel outside the shed by continuous guides, with the result that in the region of the control sprocket there are no unsupported points on the tape at which the solid lubricant stick could be applied.

The object of the present invention is to obviate said drawbacks by providing effective lubrication for the gripper transportation system in a shuttleless loom such that said system is particularly suitable for operating at the high speed required of modern looms. This is attained substantially in that in the continuous guide for the flexible tape outside the shed in a position in close proximity to the control sprocket there is provided a transverse slot through which a solid stick of porous synthetic material impregnated with a particular lubricating grease and/or oil is elastically urged with adjustable pressure against said tape. The advantages of this arrangement are immediately apparent. Firstly, excellent lubrication is possible in that as the tape slides, the stick pressed against it wears down to release the oil and/or grease contained in its pores, this being known to be the best lubrication means for obtaining long tape life. Again, the closeness of the slot to the control sprocket not only aids lubrication but also results in the least possible amount of lubricant being required for effective lubrication of the contact area between the sprocket teeth and the tape perforations, with consequent saving, and in addition by adjusting the pressure of the stick against the tape and suitably choosing the size of the stick pores it is possible to meter the quantity of lubricant left on the tape resulting from the stick wear to that quantity strictly necessary for mechanical requirements, without dangerous excess lubricant which could leave visible traces on the finished fabric.

Furthermore, in order to satisfy the condition required of high-speed looms that the flexible tape be always guided over the entire amount of its travel outside the shed, according to one modification of the present invention said transverse slot provided in the continuous guide does not extend over the entire guide width but consists of two mutually offset transverse gaps in the guide which extend transversely as far as the centre of the guide, two porous solid sticks being elastically pressed through said gaps and against the flexible tape.

In this manner, opposite each gap there is an uninterrupted guide portion which prevents any vertical deflection of the tape. The invention is described in detail hereinafter with reference to the accompanying drawings which illustrate a preferred embodiment thereof by way of non-limiting example in that technical, technological or constructional variants can be made thereto without leaving the scope of the present invention.

In said drawings:

FIG. 2 is a longitudinal middle section through the lubrication mechanism of the system of FIG. 1 to an enlarged scale;

FIG. 3 is a front view of the lubrication mechanism on the line AA of FIG. 2;

FIG. 4 is a perspective view of the porous stick according to the invention used in the lubrication mechanism of FIG. 2;

Figure 1:
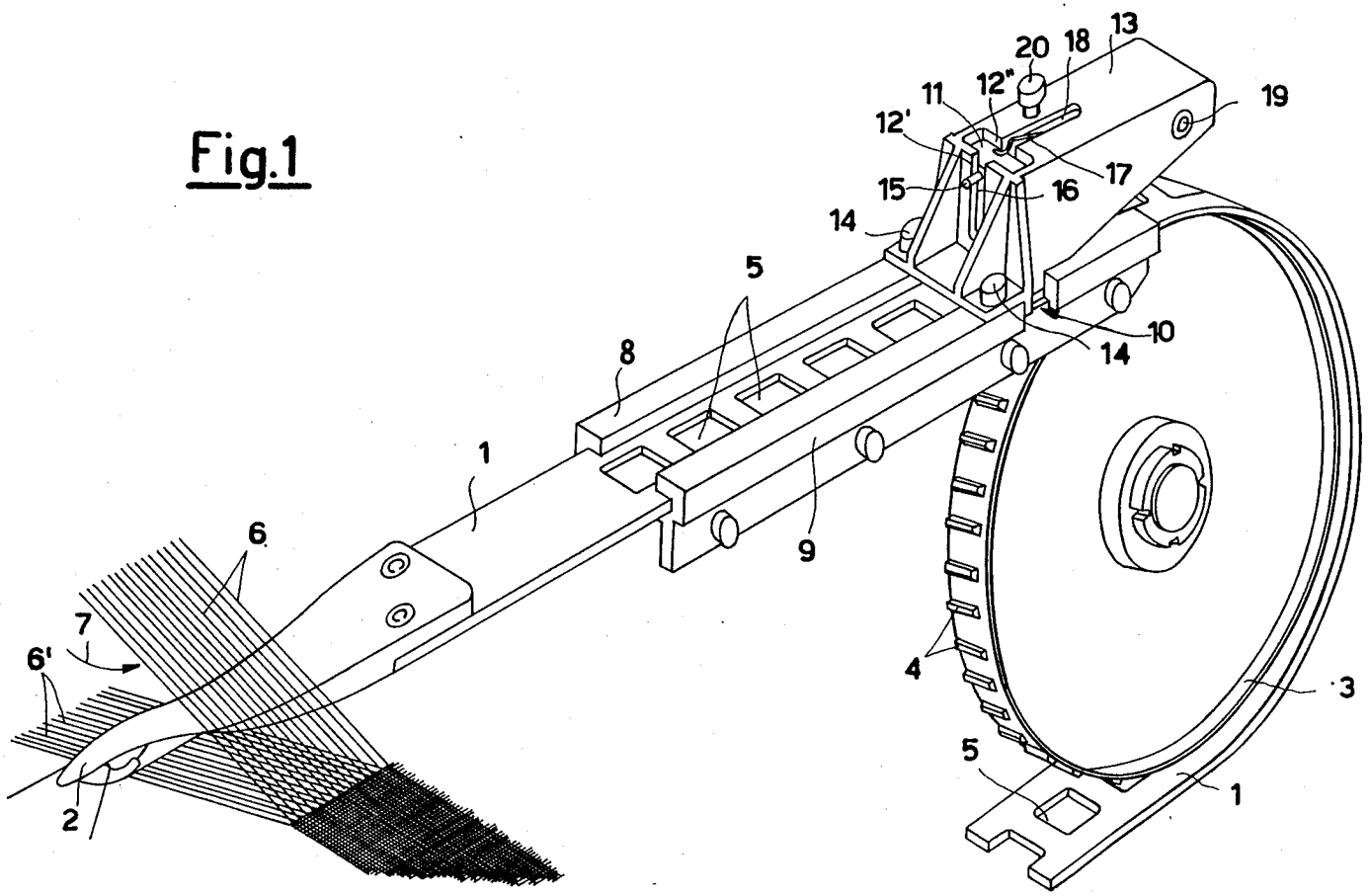
FIG. 1 is a partial perspective diagrammatic view of the gripper transportation system according to the invention.

In the figures, the reference numeral 1 indicates a flexible tape which at one end supports the gripper 2 which is fixed to it, and 3 indicates the control sprocket which drives said tape with rectilinear reciprocating motion by inserting its teeth 4 into the perforations 5 provided longitudinally in the tape 1.

The reference numerals 6 and 6' indicate the warp yarns which form the shed 7, outside which the tape 1 is guided by an continuous guide formed from two U-shaped shoulders 8 and 9. In said continuous guide 8, 9, there is provided in close proximity to the control sprocket 3 a transverse slot 10 into which a solid stick 11 of porous synthetic material is inserted, its pores 12 (see specifically FIG. 4), of suitable size depending on the specific use, being impregnated with lubricating oil and/or grease.

Said solid stick 11 is contained vertically slidable in an open vertical chamber 12 of corresponding shape provided in a lubrication mechanism 13 which is suitably fixed onto said continuous guide 8, 9 by screws 14. During its vertical sliding the stick is guided by its projecting pin 15 which is inserted into a vertical slot 16 in the front wall 12' of said chamber 12 and is pressed against the flexible tape 1 by the end 17' of a spring 17 which passes through a vertical slot 18 in the rear wall 12'' of the chamber 12 and acts against the top of the stick. Said spring 17 embraces a pin 19 supported by the casing of the lubrication mechanism 13 and its other end 17'' (see FIG. 2) cooperates with an adjustment screw 20 which enables the loading tension in the spring to be adjusted.

Figure 5:
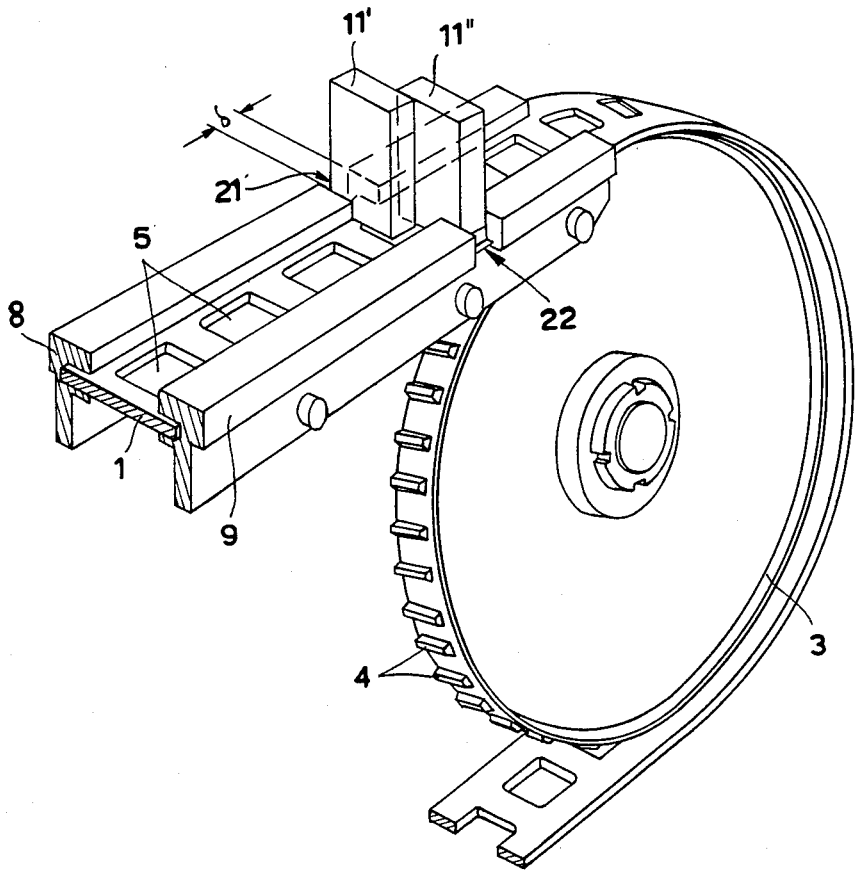
FIG. 5 is a partial perspective diagrammatic view of a further embodiment of the gripper transportation system according to the invention.

Finally, FIG. 5 shows a modified embodiment of the invention in which the transverse slot provided in the continuous guide 8, 9 consists of two transverse gaps 21 and 22 provided in the shoulder 8 and in the shoulder 9 of the guide respectively, these being mutually offset by a certain distance $\delta$ and having inserted through them two solid sticks 11' and 11'' which each extend transversely as far as the longitudinal centre line of the continuous guide 8, 9.

We claim:

1. A lubrication system for use in a shuttleless loom gripper transport mechanism of the perforated tape and toothed sprocket type wherein the gripper is attached to one end of a flexible perforated tape, the perforated tape being slidably mounted in first and second horizontal U-shaped guides located along the tape's two edges and where the teeth of the sprocket mesh with the perforations of the tape so that the tape reciprocates when the sprocket is rotated in alternate directions, wherein the improvement comprises:

said first and second U-shaped guides each having first and second transverse slots in close proximity to the sprocket through which slots a solid stick of porous synthetic material impregnated with liquid lubricant can move; and means for urging the stick of porous material against the tape with adjustable pressure.

2. A lubrication system for use in a shuttleless loom gripper transport mechanism as in claim 1 wherein the means for urging the stick further comprise:

a horizontally-mounted pivot pin;

an adjustment screw;

a bent spring having a bent portion and first and second legs;

the first leg contacting the top of the stick, the second leg contacting the adjustment screw and the bent portion embracing the pivot pin.

3. A lubrication system for use in a shuttleless loom gripper transport mechanism as in claim 1 wherein the first and second slots have corresponding first and second transverse axes, said first and second axes of said slots being displaced from one another by a fixed distance so that one slot lies further along the tape than the other.

* * * * *